US006461145B1

(12) United States Patent
Giraud et al.

(10) Patent No.: US 6,461,145 B1
(45) Date of Patent: Oct. 8, 2002

(54) FLAT FLAME BURNERS

(75) Inventors: Patrick Giraud, Paris (FR); Jean-Claude Montgermont, Le Mee sur Seine (FR)

(73) Assignee: Stein Heurtey, Ris-Orangis (FR)

( * ) Notice: Subject to any disclaimer, the term of this patent is extended or adjusted under 35 U.S.C. 154(b) by 0 days.

(21) Appl. No.: 09/512,307

(22) Filed: Feb. 24, 2000

(30) Foreign Application Priority Data

Feb. 25, 1999 (FR) ..... 99 02378

(51) Int. Cl.[7] ..... F23D 14/12; F23D 14/24; F23M 9/00

(52) U.S. Cl. ..... 431/10; 431/8; 431/9; 431/348

(58) Field of Search ..... 431/116, 115, 431/9, 8, 348, 347, 10, 284, 285, 159, 349

(56) References Cited

U.S. PATENT DOCUMENTS

| | | | | | |
|---|---|---|---|---|---|
| 2,762,428 | A | * | 9/1956 | Blaha | 431/348 |
| 3,368,605 | A | * | 2/1968 | Reed | |
| 3,481,680 | A | * | 12/1969 | Kohn | |
| 3,576,384 | A | * | 4/1971 | Perczeli et al. | 431/187 |
| 3,671,172 | A | * | 6/1972 | Chedaille et al. | 431/182 |
| 3,809,525 | A | * | 5/1974 | Wang et al. | |
| 3,836,315 | A | * | 9/1974 | Shular | |
| 3,905,751 | A | * | 9/1975 | Hemsath et al. | |
| 3,922,137 | A | * | 11/1975 | Peczeli et al. | |
| 4,004,789 | A | * | 1/1977 | Belas et al. | |
| 4,203,717 | A | * | 5/1980 | Facco et al. | |
| 4,348,168 | A | * | 9/1982 | Coulan | |
| 4,431,403 | A | * | 2/1984 | Nowak et al. | |
| 4,443,182 | A | * | 4/1984 | Wojcieson et al. | |
| 4,451,230 | A | * | 5/1984 | Bocci et al. | |
| 5,131,838 | A | * | 7/1992 | Genseler et al. | 431/348 |
| 5,697,776 | A | * | 12/1997 | Van Eerden et al. | 431/284 |
| 5,813,846 | A | * | 9/1998 | Newby et al. | 431/9 |

FOREIGN PATENT DOCUMENTS

| | | | | |
|---|---|---|---|---|
| DE | 2449986 | * | 2/1975 | |
| DE | 3529290 | * | 2/1987 | 431/183 |
| DE | DL 0268505 | * | 5/1989 | 431/353 |
| DE | 40 01 378 A | * | 7/1991 | |
| DE | 40 01 378 | * | 7/1991 | 431/350 |
| EP | 0430376 | * | 5/1991 | 431/9 |
| JP | 51-128034 | * | 11/1976 | 431/8 |
| JP | 59-161606 | * | 9/1984 | 431/9 |
| JP | 60-200008 | * | 10/1985 | 431/9 |
| JP | 1315731 | * | 6/1987 | 431/353 |
| JP | 404009511 | * | 1/1992 | 431/10 |
| JP | 7-260110 | * | 10/1995 | 431/8 |
| JP | 7-260357 | * | 10/1995 | 431/350 |
| JP | 8-159420 | * | 6/1996 | |
| JP | 8-178227 | * | 7/1996 | |
| JP | 8-159420 | * | 8/1996 | 431/159 |
| JP | 8-178227 | * | 8/1996 | 431/350 |
| JP | 9-101008 | * | 9/1997 | 431/348 |
| SU | 0595589 | * | 2/1978 | 431/182 |

* cited by examiner

*Primary Examiner*—Carl D. Price
(74) *Attorney, Agent, or Firm*—Connolly Bove Lodge & Hutz LLP

(57) ABSTRACT

A flat-flame burner for reheat, holding, and heat-treatment furnaces for treating iron and steel products. It has at least one fuel-injection pipe lying along the axis of the body of the burner, a combustion tunnel and a combustion-air feed, the air being distributed in and by the body. The fuel is introduced via the injection pipe or pipes through at least one axial orifice lying in a plane close to the external plane of the combustion tunnel, into the combustion products. This produces a first dilution of the fuel in these combustion products, the fuel/combustion products mixture thus obtained being diluted further in the combustion air.

12 Claims, 3 Drawing Sheets

FLAT FLAME BURNERS

FIELD OF THE INVENTION

The present invention relates to improvements to a flat-flame burner intended for equipping reheat, holding or heat-treatment furnaces, in particular for iron and steel products, so as to lower its NOx production appreciably.

BACKGROUND OF THE INVENTION

In order to properly understand the technical field to which the improvements forming the subject of the present invention apply, as well as the corresponding prior art, reference will firstly be made to FIGS. 1 to 4 of the appended drawings.

FIG. 1 therefore illustrates an embodiment of a prior art furnace for reheating iron and steel products, with top and bottom heating. The products to be reheated, denoted by the reference 1, are supported and transported within the furnace by a system of fixed and walking beams 2 and 3. The walking beams are moved in a motion comprising a rectangular cycle by virtue of the conjugate actions of a translation frame 4 and a lifting frame 5, in an arrangement well known to those skilled in the art. The furnace is produced in the form of a thermally insulated chamber 6 in which long-flame burners 7 and flat-flame burners 8 are placed, the latter burners being fitted into the roof of the furnace. The present invention relates to improvements to the flat-flame burners 8.

FIGS. 2 and 3 illustrate two embodiments of roof burners according to the prior art.

Shown schematically in the FIG. 2 at 9 is the combustion tunnel of a burner which has a flared opening, the shape of which is substantially in the form of a quadrant of a circle so as to propagate the stream of air and the flame of the burner along the profile of the combustion tunnel, by the Coanda effect, and along the plane P of the roof. The burner is fed with combustion air, which may or may not be preheated, via a feed pipe 10 and this air is distributed in the body of the burner through orifices 11 made in the air distributor, these orifices causing the combustion air to swirl so that this air flows helically around the fuel-injection pipe 12. The latter lies along the axis of the burner so as to bring the fuel or fuels into a zone conducive to obtaining good mixing with the combustion air. Introduction of the fuel or fuels takes place through one or more orifices 14 so as to obtain the flow portrayed by the arrow 15 in this FIG. 2.

A disc 13 is provided on the injection end of the pipe 12, the function of this disc 13 being to force the combustion air to be pressed against the internal wall of the combustion tunnel 9 so as to promote the formation of a flat flame and create a suction vortex for the combustion gases in the burner head. In FIG. 2, this vortex is portrayed by the arrow 16. The combustion gases within the chamber of the furnace are therefore recirculated at the burner head by induction of the vortex 16 created by the high-speed circulation of the air/gas mixture coming from the burner. The flame produced by this air-gas mixture spreads, as at 17, following the profile of the combustion tunnel 9 and the plane P of the roof of the furnace.

According to the prior art (FIG. 3), the roof burners may also be provided with twin fuel-injection pipes 18 and 19 having respective injection orifices 20 and 14. Moreover, this known type of burner is similar to the burner forming the subject of FIG. 2, the twin injection pipe allowing the use of two different types of fuel. A single injection of fuel via the orifices 20 may be employed, for example during the burner ignition phase, allowing better attachment of the flame at low fuel rates, particularly when the temperature of the furnace chamber is less than 750° C. (no spontaneous ignition of the mixture).

Until recently, the prior art of the flat-flame burner illustrated in FIGS. 2 and 3 was technically satisfactory from the standpoint of controlling the flame geometry and the heat flux distribution. The technique according to the prior art was optimized entirely according to combustion criteria for the purpose of obtaining an intensive flame of suitable shape. In this approach, the emission of pollutants, particularly of NOx, was regarded as secondary.

The trend in local, European and world-wide regulations has forced operators to reduce NOx emissions from their plants. Research on burner design has incorporated this constraint, particularly in the case of flat-flame burners which generate much greater amounts of NOx than long-flame burners and which have formed the subject of extensive research and numerous improvements for the purpose of limiting their discharge.

It is known that the production of NOx gases in a flame depends on its temperature and on the oxygen partial pressure in the reaction zone of this flame. In particular, it is known that the amount of NOx produced increases significantly for flame temperatures greater than 1200° C. All research on reduction of NOx products has therefore been carried out so as to reduce the temperature of the burner flame and to increase the volume of its reaction zone, particularly by diluting it with the combustion products contained within the furnace chamber and recirculated at the burner head.

FIG. 4 of the appended drawings shows a burner according to the prior art, designed so as to reduce the amount of NOx produced. In this type of burner, the fuel is injected right at the very end of the combustion tunnel of the burner, into the vortex 16 of the combustion products. The burner has a fuel-injection pipe lying along its axis and emerging in the combustion tunnel via a number of radial injectors 14. By this means, the fuel is injected radially at high speed, through the said injectors 14, into the combustion air level with the tunnel in a zone in which the combustion air is diluted with the gases from the furnace environment. This high-speed fuel injection via a small number of radial injectors furthermore divides the flame into several "small flames" which are less intensive and whose total volume is increased with respect to a single flame.

BRIEF DESCRIPTION OF THE INVENTION

Based on this prior art, the object of the present invention is to reduce the amount of NOx produced by flat-flame burners using the principle of flame dilution for the purpose of reducing its temperature and lowering the oxygen partial pressure in its reaction zone.

This technical problem is solved by a flat-flame burner having at least one fuel-injection pipe lying along the axis of the body of the burner and a combustion-air feed. The burner is characterized in that the fuel is introduced via the injection pipe or pipes, through one or more axial orifices lying in a plane close to the external plane of the combustion tunnel, into the combustion products so as to produce a first dilution of the fuel in these combustion products. The fuel/combustion products mixture thus obtained is diluted further in the combustion air.

BRIEF DESCRIPTION OF THE FIGURES

The features, operation, and advantages of the invention may be better understood from the following detailed description of the preferred embodiments taken in conjunction with the attached drawings, in which.

Further features and advantages of the present invention will emerge from the description given below with reference to FIG. 5 of the appended drawings.

Figure 1:
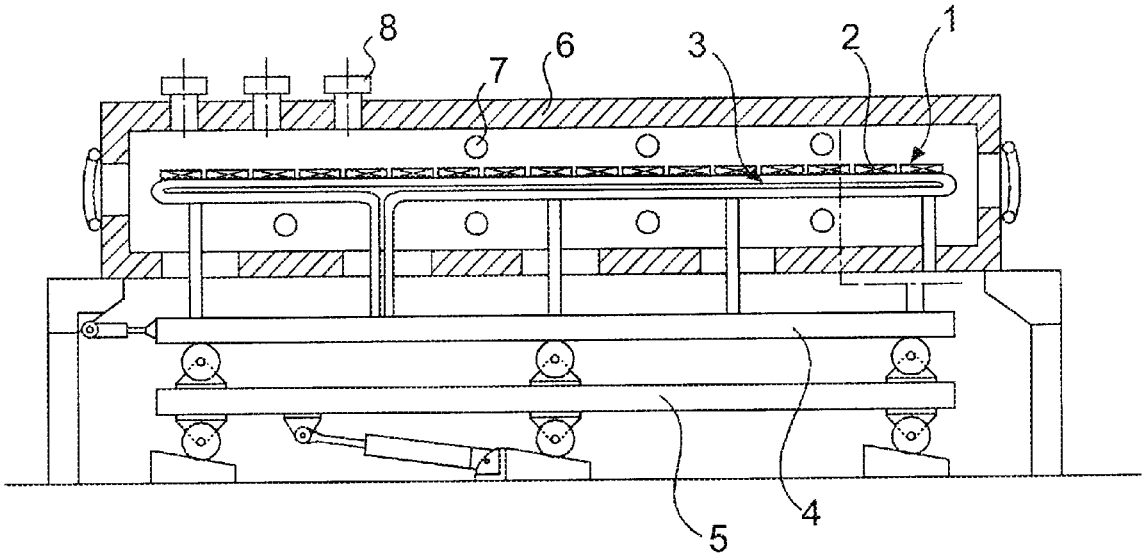
FIG. 1 PRIOR ART
FIG. 1 is a schematic view in longitudinal axial section, of a furnace of a known type for reheating iron and steel products.
Figure 2:
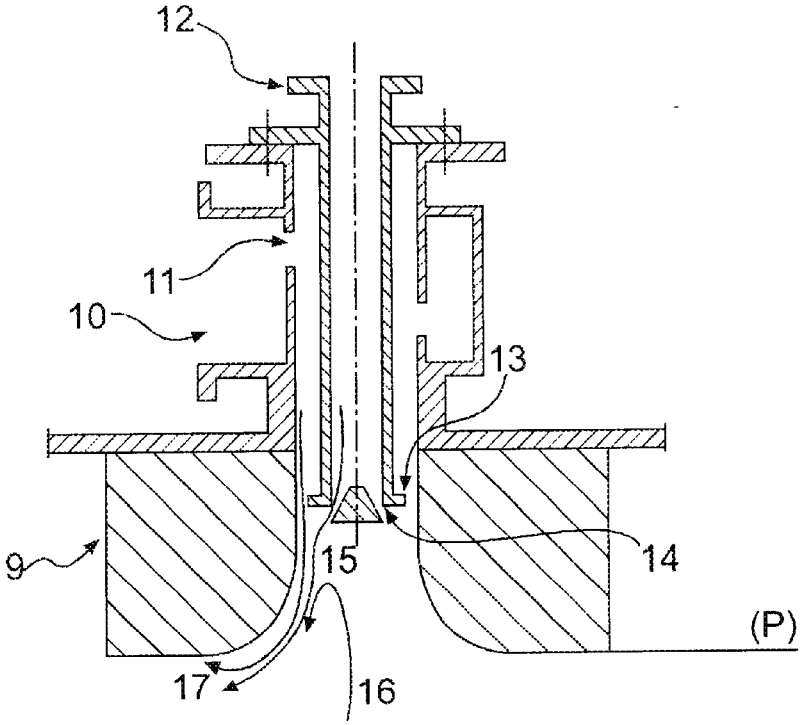
FIG. 2 PRIOR ART
FIG. 2 is a schematic view, in vertical axial section, of an embodiment of a roof burner according to the prior art, which can be mounted in a furnace as in FIG. 1.
Figure 3:
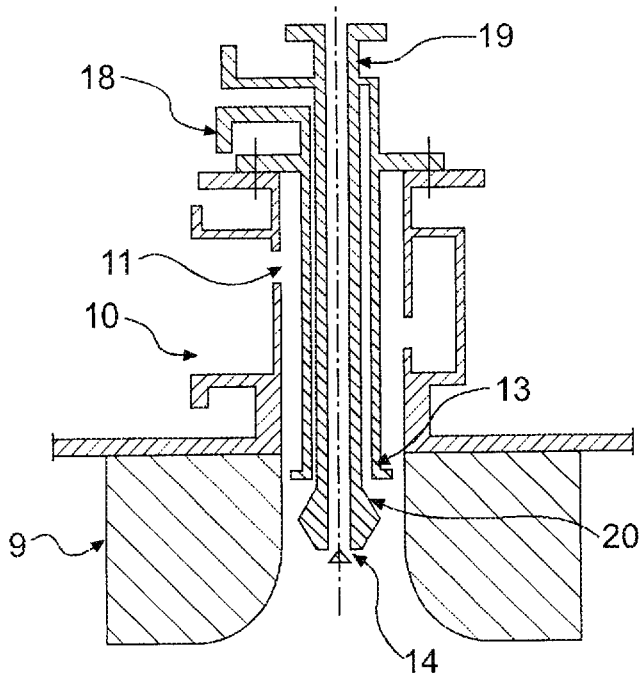
FIG. 3 PRIOR ART
FIG. 3 is a schematic sectional view, in vertical axial section, of an alternative embodiment of a roof burner according to the prior art, which can be used in the furnace forming the subject of FIG. 1.
Figure 4:
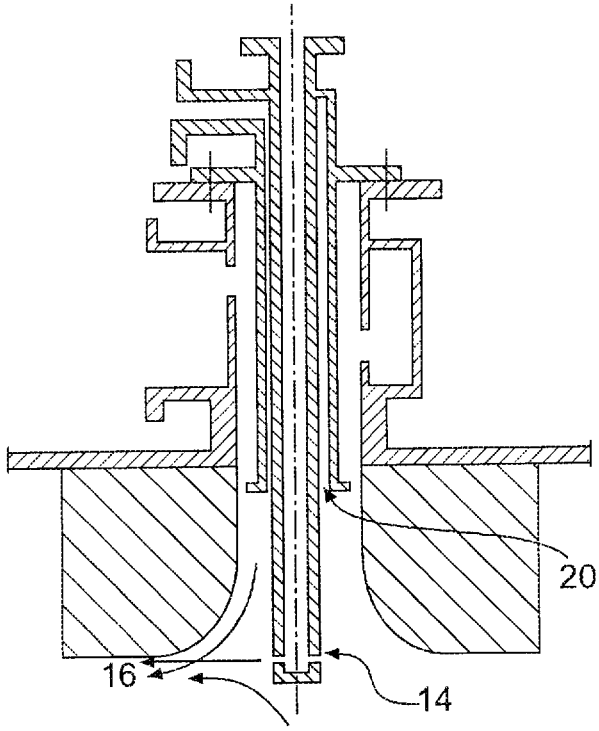
FIG. 4 PRIOR ART
FIG. 4 is a schematic view, in vertical axial section, of a flat flame burner according to the prior art, designed so as to reduce the amount of NOx produced by this burner.
Figure 5:
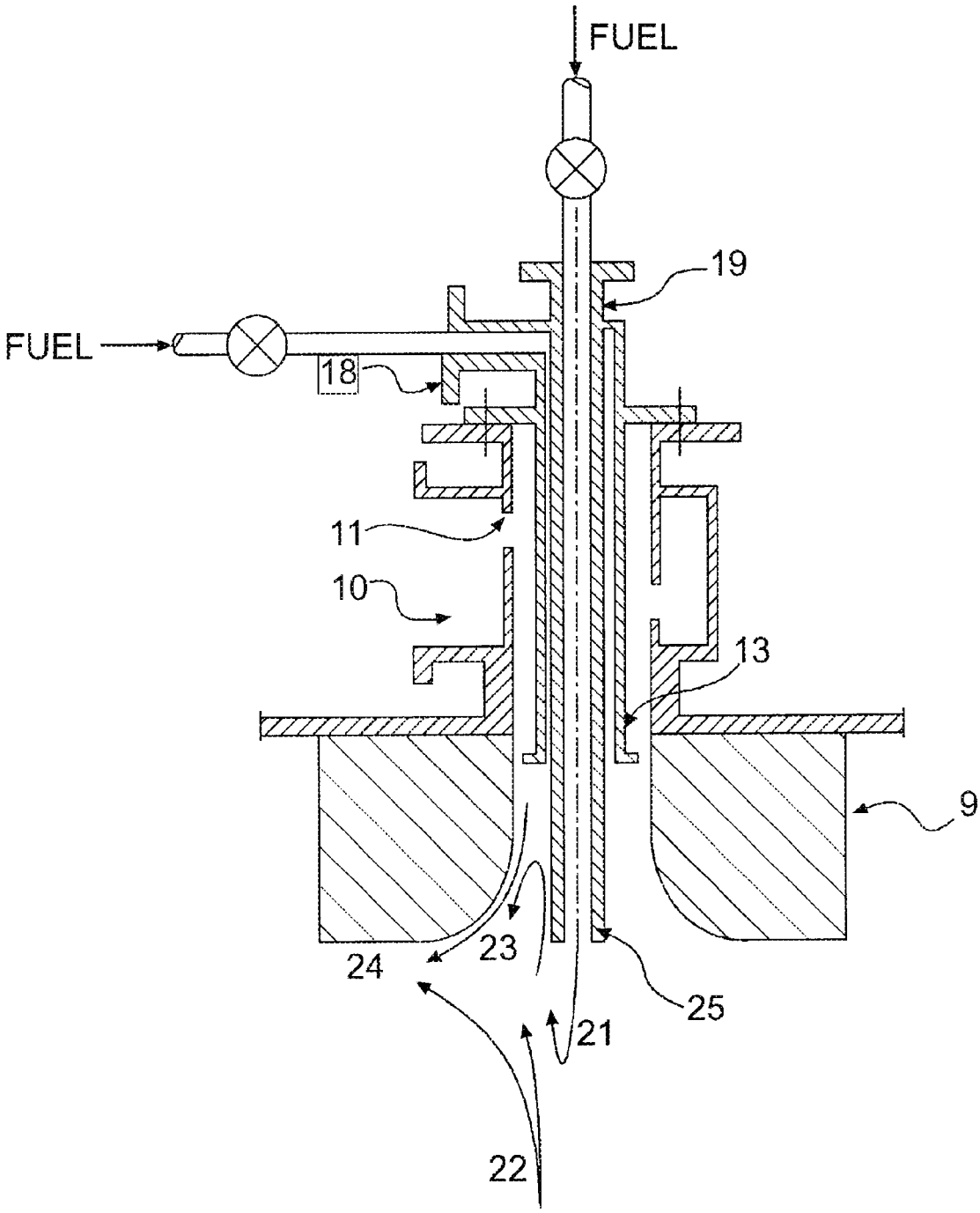
FIG. 5 is a schematic view, in vertical axial section, of an improved burner according to the present invention.

FIG. 5 is a schematic view, in vertical axial section, of an improved burner according to the invention.

As will have been understood and as mentioned above, the burner forming the subject of the invention uses the principle of flame dilution in order to reduce its temperature and lower the oxygen partial pressure in its reaction zone. This flame dilution is achieved with the combustion products located within the furnace chamber. The novelty of the present invention lies in the fact that the fuel is introduced in two steps so as to obtain double dilution: a first dilution of the fuel with the combustion products of the furnace and then a second dilution of the fuel/combustion products mixture thus obtained with the combustion air.

The embodiment of the invention illustrated by FIG. 5 includes a double fuel-feed system. This is a non-limiting example, the improvements according to the invention being able to be employed on a burner with a single fuel feed. Again in this burner there is the combustion tunnel 9, the air feed 10, the air being possibly preheated and being distributed in the body of the burner via the orifices 11, and the system of two fuel-injection pipes 18 and 19, the injection taking place along the axis of the burner.

According to the invention, the fuel is introduced via one or more axial orifices with which the injection pipes such as 18 and 19 are provided, thereby making it possible for the fuel to be fed with a low momentum. The fuel-injection pipe or pipes 18 and 19 is/are made of materials resistant to high temperatures, especially refractory materials, such as chrome steel or nickel steel or ceramics.

Axial introduction of the fuel (arrow 21) through one or more axial injection orifices 25 in the pipe 19, these lying, according to the invention, in the immediate vicinity of the plane of flame development, takes place in the combustion products (arrow 22) from the furnace environment, thereby allowing the first dilution to be achieved. This dilution is promoted by the positioning of the orifices 25 which allow the fuel to be premixed with the recirculated combustion gases at the burner head. The axial fuel-injection orifice or orifices 25 is/are of large diameter so as to limit the momentum of the fuel in order to achieve mixing with the combustion gases.This low momentum does not disturb the vortex of recirculating the combustion products induced at the burner head by the combustion air, unlike high-momentum radial injection which "cuts" the vortex and disturbs this recirculation.

The fuel/combustion gas mixture thus obtained, portrayed by the arrow 23 in FIG. 5, is entrained by the vortex existing at the burner head and then diluted with the combustion air (arrow 24) which is itself diluted with some of the recirculated combustion products (arrow 22) at the burner head.

Thus, the burner forming the subject of the present invention makes it possible to achieve a double dilution—of the fuel and the combustion products and of the combustion air and the combustion products—and finally to mix the two diluted premixtures. This optimization of the "combustion air+fuel+combustion products" mixture makes it possible to obtain a non-intensive flat flame which reduces the emissions of pollutants, particularly of NOx, it being possible for this reduction to be in a ratio of above two with respect to a burner of the same type, according to the prior art.

As illustrated in FIG. 5, the burner according to the present invention may retain the double fuel feed, with fuel being injected at different levels in the combustion tunnel 9, so as to control the mixing between the fuel or fuels, the combustion air and the recirculated combustion gases at the burner head. The two fuel-injection pipes may be used separately or simultaneously, with the flow of fuel being divided between the two injections, so as to control the shape of the flame, the quality of the premixture and the emission of pollutants.

One of the injection pipes may be used for starting the burner, for example when the temperature of the furnace is less than 700° C. in order to obtain better flame attachment, the other possibly being used in the steady state for reducing the amount of pollutants produced.

The invention therefore makes it possible to solve the problem of reducing the amount of NOx produced by a flat-flame burner, ensuring combustion of the fuel within a large volume (mixing of the combustion air, fuel and combustion products of the furnace) which makes it possible to produce a flame of lower temperature, the oxygen partial pressure of which reaction zone is reduced.

Of course, it remains the case that the present invention is not limited to the embodiments described and/or mentioned above, rather it encompasses all variants thereof.

What is claimed is:

1. A method for mixing fuel, air and recirculating combustions gases at the head of a furnace burner, comprising the steps:

locating a combustion tunnel having an outwardly flared end with an exit opening into the furnace;

creating a vortex of recirculating combustion gases at the exit;

positioning a fuel injection pipe, serving as a burner head, and axially extending through the tunnel and having an orifice sufficiently close to the tunnel exit for directly injecting fuel at low momentum exclusively into the vortex of recirculating combustion gases present at the exit, without penetrating the vortex, to form a first premixture; positioning a combustion air feed pipe to axially extend along a length of the fuel injection pipe, and located radically outward there from, for circulating air around the orifice of the fuel injection pipe thereby inducing the vortex, the air mixing with the recirculating combustion gases in a zone removed from the vortex for further diluting the first premixture in the zone and for ensuring that combustion takes place in a flame development plane in the immediate vicinity of the burner head orifice.

2. The method according to claim 1, wherein the axial fuel-injection pipe orifice diameter is preselected to be sufficiently large to limit the momentum of the fuel.

3. The method according to claim 1 together with the step of locating a second fuel injection pipe, having its orifice at a different level than that of the first fuel injection orifice, and likewise located in the combustion tunnel, for controlling the mixing between the fuel, the combustion air and the recirculated combustion products at the head of the burner.

4. The method according to claim 3 together with the step of separately controlling the flow through the first and second fuel injection pipes, with the flow of fuel being divided between the two injection pipes, for controlling the shape of a flame, the quality of the diluted mixtures, and the emission of pollutants.

5. The method according to claim 3 together with the step of simultaneously allowing flow through the first and second fuel injection pipes, with the flow of fuel being divided between the two injection pipes, for controlling the shape of a flame, the quality of the diluted mixtures, and the emission of pollutants.

6. A flat-flame burner assembly for metal treatment furnaces comprising:

a combustion tunnel having an outwardly flared end with an exit opening into a furnace, a vortex of recirculating combustion gases being present at the exit;

fuel injection means, serving as a burner head, and axially extending through the tunnel and having an orifice sufficiently close to the tunnel exit for directly injecting fuel at low momentum exclusively into the vortex of recirculating combustion gases present at the exit, without penetrating the vortex, to form a first premixture;

combustion air feed means axially extending along a length of the fuel injection means, and located radically outward there from, for circulating air around the orifice of the fuel injection means thereby inducing the vortex, the air mixing with the recirculating combustion gases in a zone removed from the vortex for further diluting the first premixture in the zone and for ensuring that combustion takes place in a flame development plane in the immediate vicinity of the burner head orifice.

7. A burner according to claim 6 wherein the axial fuel-injection orifice has a preselected diameter that is large enough to limit the momentum of the fuel.

8. A burner according to claim 6, wherein the injection means is a pipe made of materials resistant to high temperatures.

9. A burner according to claim 6 together with a second fuel injection means in the form of a pipe having its orifice at a different level than that of the first fuel injection means orifice, and likewise located in the combustion tunnel, for controlling the mixing between the fuel, the combustion air and the recirculated combustion products at the head of the burner.

10. A burner according to claim 9, wherein the first and second fuel injection pipes are separately controlled, with the flow of fuel being divided between the two injection pipes, for controlling the shape of a flame, the quality of the premixtures, and the emission of pollutants.

11. A burner according to claim 9, wherein the fuel injection pipes are used simultaneously with the flow of fuel being divided between the two injection means for controlling the shape of a flame, the quality of the premixture, and the emission of pollutants.

12. A burner according to claim 9, wherein one of the injection pipes is used for igniting the burner and the other is used to reduce the amount of pollutants produced.

* * * * *